United States Patent [19]

Malott

[11] Patent Number: 4,995,211

[45] Date of Patent: Feb. 26, 1991

[54] EDGE-TO-EDGE ATTACHMENT SYSTEM FOR DISPLAY PANELS

[75] Inventor: John S. Malott, Cincinnati, Ohio

[73] Assignee: Downing Displays, Inc., Cincinnati, Ohio

[21] Appl. No.: 470,300

[22] Filed: Jan. 25, 1990

[51] Int. Cl.[5] ..... E04C 1/30

[52] U.S. Cl. ..... 52/582; 52/71; 52/284; 52/584; 403/387

[58] Field of Search ..... 52/284, 285, 582, 584, 52/71; 292/302; 403/387; 160/135, 182, 211, 351

[56] References Cited

U.S. PATENT DOCUMENTS

| | | | |
|---|---|---|---|
| 2,137,767 | 11/1938 | Betcone | 52/584 X |
| 3,788,378 | 1/1974 | Sobel | 160/135 |
| 4,625,483 | 12/1986 | Zacky et al. | 52/282 X |

FOREIGN PATENT DOCUMENTS

| | | | |
|---|---|---|---|
| 424165 | 5/1967 | Switzerland | 52/586 |

*Primary Examiner*—David A. Scherbel
*Assistant Examiner*—L. J. Watson
*Attorney, Agent, or Firm*—Frost & Jacobs

[57] ABSTRACT

An attachment system joining the side edges of adjacent display panels. Each panel has first and second side edges, the first side edge of one panel joinable with the second side edge of an adjacent panel. The first and second side edges comprise first and second frame members affixed to the panel body. The first and second frame members are substantially identical, being coextensive and having outer faces with corresponding abutment surfaces thereon. Each first and second frame member has a longitudinal opening extending from its upper end through its lower end. Each first frame member has in its outer face a slot at its lower end communicating with its longitudinal opening and at least one bore. Each second frame member has, extending from its forward face, a headed stud near its bottom end, and at least one alignment stud. A U-shaped latch member has a handle position, a short leg and a long leg. The long leg is captively mounted in the opening of the first frame member at its upper end, being vertically shiftable and rotatable therein. When the first frame element of a panel is joined to the second frame element of an adjacent panel, the second frame element headed stud is received in the first frame element slot and opening; the at least one second frame element alignment stud is received in the at least one first frame element bore; and the latch member is lifted and rotated and the short leg is inserted into the second frame member opening, completing the attachment.

18 Claims, 2 Drawing Sheets

EDGE-TO-EDGE ATTACHMENT SYSTEM FOR DISPLAY PANELS

TECHNICAL FIELD

The invention relates to an attachment system for joining the side edges of adjacent display panels, and more particularly to such a system which is self-aligning and wherein all the required parts are permanently mounted on the panels, themselves.

BACKGROUND ART

While not necessarily so limited, the invention will be described in its application as an attachment system for joining the side edges of adjacent, lightweight, display panels. It is common practice to make displays for trade shows, conventions, and the like from lightweight, durable, fire retardant panels. This is true because of the versatility of the panels and the wide variety of displays which can be made with them. The panels are easily assembled and disassembled. This and their lightweight, durable construction renders them easy to transport.

The panels are generally joined together edge-to-edge, and prior art workers have devised numerous means for accomplishing this. The prior art attachment systems are generally characterized by the use of separate clips, latch means or the like. This is sometimes awkward and time consuming, since the panels must be held in alignment while the attachment means are affixed thereto.

The present invention is based upon the discovery that an attachment system for display panels can be devised wherein all of the attachment elements required are permanently mounted on and carried by the panels themselves. No separate elements are required. The system of the present invention is self-aligning, and the panels are constantly urged together.

With the system of the present invention, the panels can be more easily and quickly joined together. The attachment system is simple in construction and easy to manufacture.

DISCLOSURE OF THE INVENTION

According to the invention there is provided an attachment system for joining the side edges of adjacent display panels. Each display panel has first and second side edges such that the first side edge of one display panel will join with the second side edge of an adjacent display panel. The first and second side edges of each panel comprise first and second frame members affixed to the panel body. The first and second frame members are substantially identical, being coextensive and having outer faces with corresponding abutment surfaces thereon. Each of the first and second frame members has a longitudinal opening extending from its upper end through its lower end. The first frame member of each panel has a slot at its lower end formed in its outer face and communicating with its longitudinal opening. The second frame member of each panel has a headed stud near its bottom end and extending outwardly of its forward face. The first frame member of each panel has at least one bore in its outer face between its top and bottom ends. The second frame member of each panel has at least one alignment stud mounted thereon and extending outwardly of its forward face. A U-shaped latch member is provided having a handle portion terminating in a short leg and a long leg. The long latch leg is captively mounted in the opening of the first frame at the upper end thereof and is vertically shiftable and rotatable therein. The short latch leg normally extends exteriorly along one side of the first frame element. When the first frame element of a display panel is joined to the second frame element of an adjacent display panel, the second frame element headed stud is received in the first frame element slot and opening. The at least one alignment stud of the second frame element is received in the at least one bore of the first frame element. Finally, the latch member is lifted and rotated about the axis of its long leg so that its short leg clears the upper ends of the frame members and is aligned with the opening of the second frame member. The latch member is then lowered, inserting the short latch leg into the opening of the second frame element, completing the attachment.

DETAILED DESCRIPTION OF THE INVENTION

The invention is illustrated in FIGS. 1-10, wherein like parts have been given like index numerals.

Figure 10:
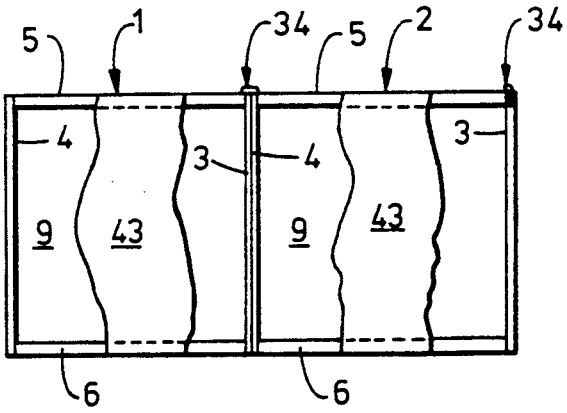
FIG. 10 is an elevational view of a pair of display panels joined together in the manner taught herein.

A pair of exemplary display panels are generally indicated at 1 and 2 in FIG. 10. While panels 1 and 2 are illustrated as being square and planar, it will be understood that the height, width and shape of the panels are non-limiting, so long as they are provided with opposite rectilinear edges intended to be mated with corresponding edges of adjacent panels. For example, one or both of panels 1 and 2 could be curved or otherwise configured in the horizontal plane. Each of the panels 1 and 2 is provided with peripheral frame members, at least on their rectilinear matable edges. To this end, each of the panels 1 and 2 is provided with a first frame member 3 and a second frame member 4. Any frame member 3 is capable of attachment to any frame member 4. The panels 1 and 2 are illustrated as having (as viewed in FIG. 10) upper and lower frame members 5 and 6, extending between the frame members 3 and 4.

While the frame members 5 and 6 may be of any appropriate cross-sectional configuration, for convenience and simplicity all of the frame members 3 through 6 could be made of the same extrusion or molding. In a preferred embodiment, the frame elements are made of an aluminum extrusion, because of its strength and lightweight characteristics. However, other apropriate extruded or molded materials may be substituted therefor.

Figures 1, 2, 3, 4, 5, 6, 7:
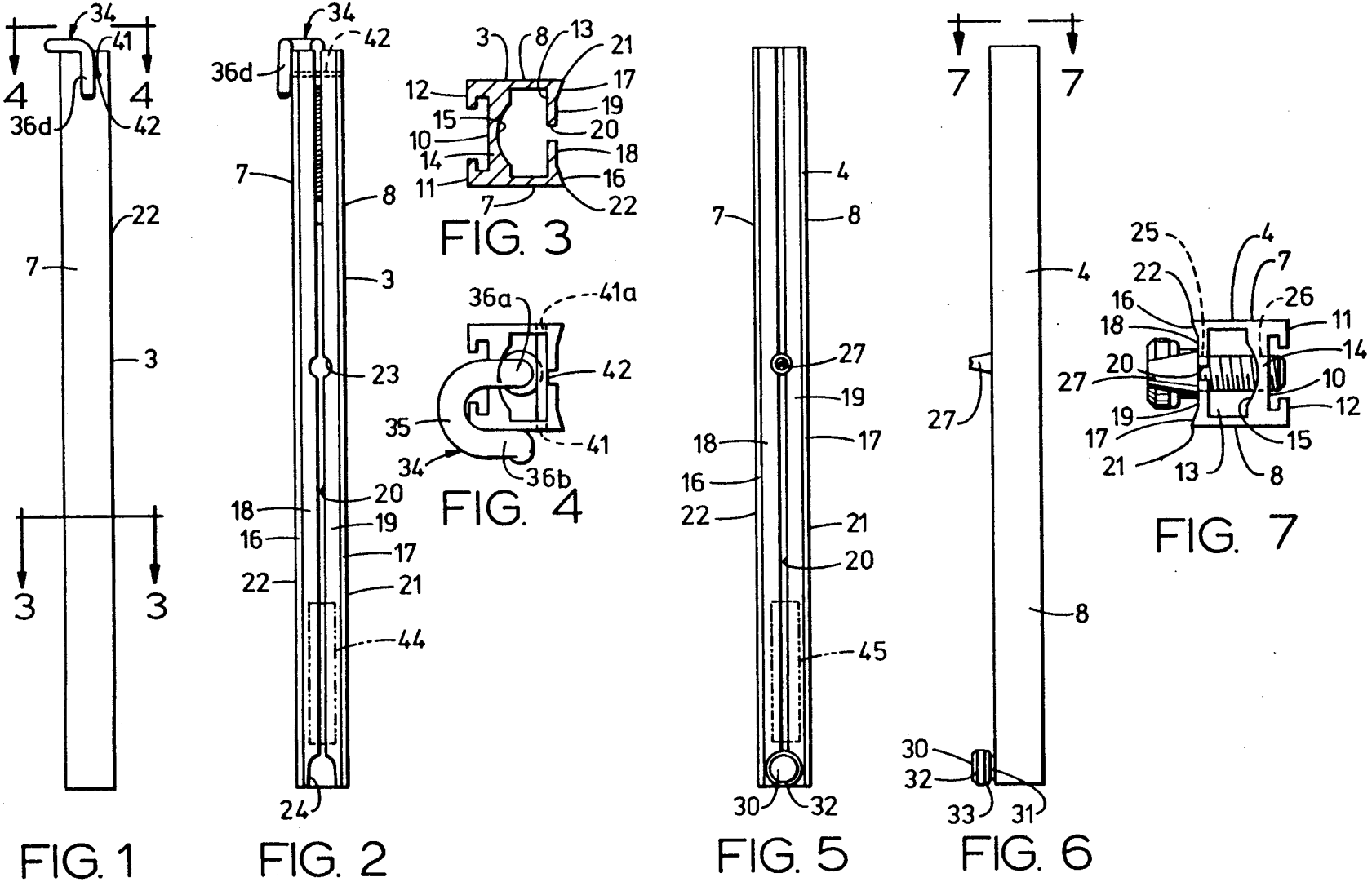
FIG. 1 is a side elevational view of a first panel frame member of the present invention.
FIG. 2 is a front elevational view of the panel frame member FIG. 1.
FIG. 3 is a cross sectional view taken along section line 3—3 of FIG. 1.
FIG. 4 is a top view taken 4—4 of FIG. 1.
FIG. 5 is a front elevational view of a second panel frame member of the present invention.
FIG. 6 is a side elevational view of frame member of FIG. 5 as seen from the right of FIG. 5.
FIG. 7 is a plan view of the panel frame member of FIGS. 5 and 6, as seen along the line 7—7 of FIG. 6.
Figure 8:
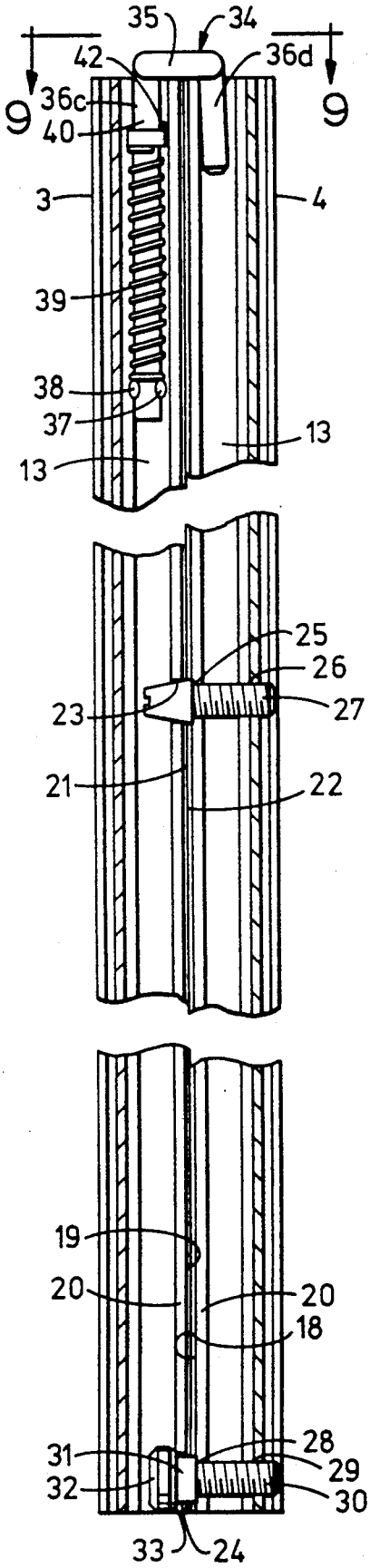
FIG. 8 is a longitudinal cross sectional elevational view of the panel frame members of FIGS. 1 and 6 joined together.

FIGS. 1 and 2 constitute side and front elevations of frame member 3. FIG. 3 is a cross-sectional view taken along section line 3—3 of FIG. 1, illustrating the cross-sectional configuration of the frame member. The extrusion has planar side surfaces 7 and 8. That surface facing the panel body or core 9 (see FIG. 10) may, if desired, be provided with a T-shaped slot 10 for purposes of material savings and weight reduction. When this is done, the extrusion has two longitudinal surfaces 11 and 12 adapted to abut the adjacent edge of the panel core. Near that surface of the extrusion which is intended to abut or mate with corresponding surface of a frame member 4, the extrusion is provided with a substantially rectangular longitudinal opening 13. The T-shaped slot 10 and the opening 13 define a web 14. The web 14 has an arcuate depression 15 formed therein, enlarging the central portion of opening 13.

That side of the extrusion intended to face and mate with an adjacent frame member 4 has inwardly sloping surfaces 16 and 17 leading from the sides 7 and 8, respectively to co-planar surfaces 18 and 19, which are separated by a slot 20 communicating with the opening 13.

The juncture of the extrusion side 8 and the inwardly sloping surface 17 forms an edge 21. Similarly, the juncture of the extrusion side 7 and the inwardly sloping surface 16 forms an edge 22. The edges 21 and 22 constitute the mating or abutting surfaces of frame member 3, adapted to abut corresponding surfaces on frame member 4.

Turning to FIG. 2, it will be noted that a circular bore 23 is formed in surfaces 18 and 19, and intersects slot 20. The slot 20, as viewed in FIG. 2, terminates at its lower end in an enlarged slot 24. The slot 24 has an arcuate upper end, terminating in parallel sides. The purpose of bore 23 and enlarged slot 24 will be apparent hereinafter.

FIGS. 5, 6 and 7 illustrate frame member 4. A comparison of FIGS. 3 and 7 clearly illustrates that frame member 4 is made from the same extrusion as frame member 3, and like parts and surfaces are given the same index numerals.

As is most clearly shown in FIG. 7, a perforation 25 extends through surfaces 18 and 19, and intersects slot 20. A similar bore 26 extends through web 14. The bores 25 and 26 are coaxial and are threaded. These bores are so positioned that when the frame members 3 and 4 are abutted or mated, the bores 25 and 26 of frame member 4 will be coaxial with the bore 23 of frame member 3. An alignment stud 27, having a conical head, is threadedly engaged in the bores 25 and 26. The purpose of alignment stud 27 will be apparent hereinafter.

Reference is specifically made to FIGS. 5 through 8. A threaded bore 28 is formed in the surfaces 18 and 19 of frame member 4, intersecting slot 20, and located near the bottom of frame member 4 (as viewed in these figures). A second threaded bore 29 is formed in the web 14. The bores 28 and 29 are adapted to receive a headed stud 30 and, when the frame member 4 is abutted or mated with frame member 3, the bores 28 and 29 lie opposite the enlarged slot 24.

The stud 30 has a shouldered portion 31 surmounted by a button-like head 32. On the shouldered portion, adjacent the head 32, an O-ring 33 is provided. The purpose of headed stud 30 will be apparent hereinafter.

Reference is now made to FIGS. 1, 2, 4 and 8. The upper end of frame member 3 captively mounts a latch member, generally indicated at 34. The latch member 34 is formed of rod stock and comprises a generally U-shaped member having an arcuate crown or base portion 35 terminating at either end in parallel leg portions 36*a* and 36*b* (see FIG. 4). Leg portions 36*a* and 36*b* terminate in downwardly depending leg portions 36*c* and 36*d*, respectively. The angle formed between leg portions 36*a* and 36*c* is substantially 90°, and the same is true of the angle formed between leg portions 36*b* and 36*d*. As is apparent from FIG. 8, the leg portion 36*c* is considerably longer than the leg portion 36*d*. The leg portion 36*c* (as viewed in FIG. 8) is essentially vertical, while the leg portion 36*d* is angled away from leg portion 36*c* by a small angle, such as 4°.

Leg portion 36*c*, near its lower end (as viewed in FIG. 8) is provided with a pair of diametrically opposed upsets 37 and 38. A coil spring 39 is mounted on and surrounds leg portion 36*c*. The upsets 37 and 38 serve as a seat for the lower end of spring 39 (as viewed in FIG. 8). A ring 40 is mounted on leg portion 36*c*, above spring 39, and is freely shiftable along the leg portion 36*c*. The ring 40 serves as a seat for the upper end of coil spring 39, as will be apparent hereinafter.

The latch member 34 is captively mounted with respect to frame member 3 in the following manner. The long leg portion 36*c* of latch member 34 is inserted into the upper end of opening 13 of frame member 3. Thereafter, the ring 40 is depressed so as to slightly compress coil spring 39. The sides 7 and 8 of the frame member 3 are provided with a pair of coaxial holes 41 and 41*a* as shown in FIG. 4. A roll pin 42 is then inserted in one of these holes, across opening 13 and into the other of the holes. When in place, the roll pin 42 has its ends located in holes 41 and 41*a* with its body portion spanning opening 13 and located above ring 40. Roll pin 42 prevents upward movement of ring 40 and is so located, and so locates the ring 40, as to cause coil spring 39 to be slightly compressed. In this manner, the latch means 34 is captively mounted with respect to frame member 3.

Crown or base portion 35 of latch member 34, together with its leg portions 36*a* and 36*b*, constitute a handle by which the latch member 34 may be grasped. When the latch member is not in use, the partially compressed coil spring 39 will cause the above-described handle portion to abut the adjacent end of frame member 3, with the short leg portion 36*d* located along either frame member side 7 or frame member side 8. This is shown in FIGS. 1 and 2. The handle portion of latch member 34 may be grasped and pulled upwardly against the action of coil spring 39 until the short leg portion 36*d* clears the adjacent end of frame member 3, whereupon the latch member 34 may be rotated about the axis of the long leg portion 36*c*, for reasons to be set forth hereinafter.

Reference is now made to FIG. 10. While the specific structure of panels 1 and 2 does not constitute a limitation of the present invention, the panels 1 and 2 will be briefly described to complete the description of the exemplary embodiment.

In this embodiment each panel has a central body or core 9 having a thickness substantially equal to the width of the frame members from side-to-side thereof. The frame members 3–6 each abut an adjacent edge of core 9. The core 9 of each panel is preferably made of lightweight material such as paper or plastic material, foamed material or the like. The manner in which the frame elements 3–6 are attached to their respective core 9 does not constitute a limitation. In this instance, each side of each panel is provided with an adhesive coated film of such size as to completely cover core 9 and the side surfaces of each frame element 3–6. Such film sheets are fragmentarily shown in FIG. 10 at 43 Since both film sheets on each side of each panel adhesively engage both the core 9 and the frame members 3–6, each core 9 will be firmly mounted within its frame members 3–6. Both the cores 9 and the film sheets 43 are preferably made of fire resistant materials.

The invention having been described in detail, the manner in which it operates can now be set forth.

The frame member 3 of panel 1 will have its latch means 34 in its normal position, as illustrated in FIGS. 1 and 2. In the attachment of panel 1 to panel 2, the panel 1 is caused to approach panel 2 such that the lower end of frame member 3 of panel 1 contacts frame member 4 of panel 2 just above the headed stud 30. The shouldered portion 31 of headed stud 30 is of such length that with compression of the O-ring 33 mounted thereon the frame member 3 of panel 1 can be angled with respect to the vertical enough to permit clearance for the conical head of alignment stud 27. A downward movement of frame member 3 will cause the head 32 of headed stud 30 to enter the opening 13 of frame member 3 with its shouldered portion 31 engaged in the enlarged notch 24 of frame member 3. When the headed stud 30 is fully seated in the notch 24 and opening 13 of frame member 3, the conical head of alignment stud 27 will be in position to enter the bore 23 in frame member 3. At this point, frame member 3 of panel 1 will assume a parallel abutting relationship with the frame member 4 of panel 2. The resilient O-ring 33 mounted on the headed stud 30 will assure that the abutment between frame members 3 and 4 will be tight at their bottom ends, as viewed in FIGS. 8 and 10. The attachment is completed and secured by grasping the handle portion of latch member 34 and pulling it upwardly against the action of coil spring 39, until the shorter leg portion 36*d* of latch member 34 clears the upper ends of frame members 3 and 4. The latch member is then rotated about the axis of long leg portion 36*c* until the short leg portion 36*d* is aligned with the opening 13 of frame member 4. Thereafter, the short leg portion 36*d* is caused to enter the opening 13 in frame member 4, locking frame members 3 and 4 (and panels 1 and 2) together.

Figure 9:
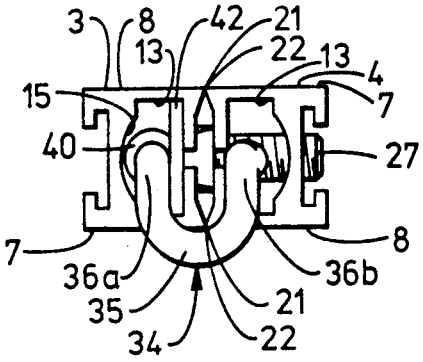
FIG. 9 is a plan view of the panel frame elements of FIG. 8, as seen along line 9—9 of FIG. 8.

As will be apparent from FIG. 9, the ring 40 on latch member 34 and the arcuate depression 15 of the web 14 of frame member 3 cooperate to center the long leg portion 36*c* within the opening 13 of frame member 3. As is apparent from FIG. 8, the slight angularity of the short leg portion 36*d* with respect to the long leg portion 36*c* provides a wedging action resulting in a tight abutment of the upper ends of frame members 3 and 4, and also tends to center the short leg portion 36*d* in the opening 13 of frame member 4.

At this point, the panels 1 and 2 are firmly joined together. It will be apparent that the attachment system of the present invention is not only self-aligning, but also urges the frame member 3 of panel 1 and the frame member 4 of panel 2 into a tight abutting relationship.

To release panel 1 from panel 2, it is only necessary to grasp the handle portion of latch member 34 and pull it upwardly until its short leg portion 36*d* is removed from the opening 13. The latch member is then rotated about the axis of its long leg portion 36*c* until the short leg portion 36*d* lies along either the side 7 or the side 8 of frame member 3 of panel 1. Release of the handle portion of the latch member will cause the latch member to assume its normal, unused position, such as the position shown in FIGS. 1 and 2. At this point, the frame member 3 of panel 1 and the frame member 4 of panel 5 are caused to separate from each other until the conical head of alignment stud 27 has been removed from perforation 23 of frame member 3. This last mentioned movement is permitted by resilient O-ring 24 mounted on headed stud 30. Thereafter, panel 1 and its frame member 3 are lifted upwardly with respect to panel 2 and its frame member 4, disengaging the headed stud 30 from the enlarged notch 24, completing the separation of the panels.

From the above description, it will be noted that the attachment system of the present invention is self-aligning, and urges adjacent panels into edge-to-edge abutment. The edges of adjacent panels need not be held in alignment while separate pieces are used to accomplish the attachment. In the attachment system of the present invention, all of the attachment elements are mounted on the frame members 3 and 4 of the panels, and no loose parts are required.

Returning to FIGS. 3 and 7, it will be noted that the surfaces 18 and 19 of frame members 3 and 4 are inset slightly from the abutment surfaces 21 and 22. It is within the scope of the invention to adhere, by adhesive or the like, a strip of resilient, opaque material (such as felt or the like) to the surfaces 18 and 19 of one or both of frame members 3 and 4, so that when the frame members are joined together, the joint will be sealed against the passage of light therethrough. Such light sealing strips are fragmentarily shown in broken lines at 44 and 45 in FIGS. 2 and 5.

Depending upon the length of frame members 3 and 4, the frame member 4 may be provided with more than one alignment stud 27. In other words, for longer frame elements, the frame element 4 may be provided with two or more alignment studs 27 substantially evenly spaced between its upper end and the headed stud 30. It will be understood that the frame element 3 will be provided with a similar number of perforations 23, correspondingly placed therealong.

Words such as "upper" , "lower" , "horizontal" , "vertical" , "top" and "bottom" are used herein and in the claims in conjunction with the drawings for purposes of clarity. It will be understood that, in use, the panels can achieve various orientations.

Modifications may be made in the invention without departing from the spirit of it. For example, it will be understood that latch number 34 could be captively mounted in the frame member 4 in the same manner described above. Similarly, the alignment stud 27 and the headed stud 30 could be mounted on frame member 3, the bore 23 and notch 24 being formed in frame member 4.

In instances where weight is not a limiting factor, and the panel itself is made of material of sufficient strength, the separate frame elements 3 and 4 may be eliminated, and the corresponding edges of the panel itself may be configured in a manner similar to frame elements 3 and 4. It will be understood that the opening 13 in frame element 3 need only exist at the upper and lower ends thereof but is shown as extending the full length of the frame element as a matter of manufacturing convenience. The same is true of frame element 4, where the opening 13 is used only at the upper end of the frame element. Where the frame elements are eliminated and the actual panel edges, themselves, are used, that edge corresponding to frame element 3 will be provided with an opening 13 at its upper end only long enough to accommodate the long leg portion 36c of the latch member 34. The lower end of the same panel edge will be provided with an enlarged slot equivalent to slot 24 and an opening equivalent to opening 13 only of such length as to receive the head of the headed stud 30. This same panel edge will be provided with a bore equivalent to bore 23 to receive the conical head of alignment stud 27. That edge of the panel, equivalent to frame element 4 will be provided with a headed stud 30 and an alignment stud 27. The upper end of this panel edge will be provided an opening equivalent to opening 13 of a depth sufficient to receive the short leg portion **36*d* of the latch 34**. The manner in which such panels are joined edge-to-edge, and the manner in which they are disengaged from each other, would be substantially the same as described above.

What is claimed is:

1. An attachment system for joining display panels, each panel having first and second side edges, said first side edge of each panel being joinable with said second side edge of any other of said panels and said second side edge of each panel being joinable with said first side edge of any other of said panels, each of said panels having a body portion, said first and second edges of each panel comprising first and second frame members affixed to said panel body, said first and second frame members being substantially identical, rectilinear and coextensive, said first and second frame members each having a pair of longitudinal sides, an upper end, a lower end, and a longitudinal outer face with abutment surfaces thereon, each of said first and second frame members having a longitudinal opening therein extending from said upper end through said lower end, cooperating means on said first and second frame members of each panel for joining the first and second frame members of adjacent panels near said lower ends thereof, cooperating means on said first and second frame members of each panel, between the upper and lower ends thereof, for aligning said first and second frame members of adjacent panels when joined together, and latch means captively mounted in said opening at the upper end of the same one of said first and second frame members of each panel and shiftable between an inoperative position and an operative position wherein it engages the opening in the other of said first and second frame members of an adjacent panel.

2. The attachment system claimed in claim 1 wherein said means for joining the first and second frame members of adjacent panels near said lower ends thereof comprises a headed stud extending from said face of one of said first and second frame members near said lower end thereof, said headed stud having a shouldered portion adjacent its head, said head of said headed stud being spaced from said frame member face by said shouldered portion, the other of said first and second frame members having a notch in its face extending from its lower end and communicating with its opening, said headed stud being insertable into said opening from said frame member lower end with said shouldered portion receivable in said notch.

3. The attachment system claimed in claim 1 wherein said means for aligning the first and second frame members of adjacent panels when joined together comprises at least one alignment stud extending from the face of one of said first and second frame members between said upper and lower ends thereof and at least one bore in the face of the other of said first and second frame members correspondingly located between its upper and lower ends, said at least one alignment stud entering said at least one bore when said first and second frame members are joined together.

4. The attachment system claimed in claim 1 wherein said latch means for each panel comprises a U-shaped latch member having a base portion terminating at its ends in legs, initial equal-length portions of said legs adjacent said base portion being coplanar therewith and constituting, together with said base portion, the handle of said latch means, the remaining portions of said legs extend downwardly at about 90° to said initial portions, one of said downwardly depending leg portions constituting a long leg portion and the other of said downwardly depending leg portions constituting a short leg portion, the long leg portion of the latch means for each panel extending downwardly into the upper end of the opening of the same one of said first and second frame members and is captively mounted in said opening, said latch means being rotatable in said opening about the axis of said long leg portion and vertically shiftable axially of said long leg portion, when the first and second frame members of adjacent panels are joined together, said latch means being shiftable and rotatable from a normal unactuated position wherein said latch means handle portion rests on the upper end of said frame member in which it is captively mounted with its short leg portion lying along one side of that frame member, to an intermediate raised position wherein said latch means short leg portion clears the upper ends of said frame members and is aligned with the opening of that frame member it is to engage, and to an actuated position wherein said short leg enters and engages said opening of said last mentioned frame member and said latch handle portion rests on the upper ends of said frame members, completing the joinder of said adjacent panels.

5. The attachment system claimed in claim 1 wherein said corresponding abutment surfaces of each of said first and second frame members comprise parallel edges formed by the junctures of said face of said frame member with the sides thereof, said frame member face between said abutment surfaces being slightly inset thereof.

6. The attachment system claimed in claim 2 including a compressible O-ring on said shouldered portion of said headed stud to urge said corresponding abutment surfaces at said lower ends of said frame members into abutting relationship.

7. The attachment system claimed in claim 2 wherein said means for aligning the first and second frame members of adjacent panels when joined together comprises at least one alignment stud extending from the face of one of said first and second frame members between said upper and lower ends thereof and at least one bore in the face of the other of said first and second frame members correspondingly located between its upper and lower ends, said at least one alignment stud entering said at least one bore when said first and second frame members are joined together.

8. The attachment system claimed in claim 4 including a pair of upsets formed on said long leg portion of each latch means near the free end of said long leg portion, a coil spring mounted on said long leg portion above said upsets, a ring mounted on said long leg portion above said spring and slidable along said long leg portion, said upsets and said ring comprising seats for the ends of said spring, a roll pin extending from side to side of the frame member opening in which said long leg portion is located, said roll pin engaging said ring to slightly compress said coil spring and to render said latch means long leg portion captive in its respective frame member opening, said coil spring urging said latch means to either of its normal unactuated positions and to its actuated position.

9. The attachment system claimed in claim 4 wherein said latch member short leg portion lies at a slight angle to said long leg portion and is so spaced therefrom as to engage its respective frame member opening with a wedging action.

10. The attachment system claimed in claim 5 including a strip of opaque resilient material mounted on the faces of at least one of said first frame members and said second frame members to render the abutment joint between first and second frame member of attached adjacent panels light tight.

11. The attachment system claimed in claim 7 wherein said latch means for each panel comprises a U-shaped latch member having a base portion terminating at its ends in legs, initial equal-length portions of said legs adjacent said base portion being coplanar therewith and constituting, together with said base portion, the handle of said latch means, the remaining portions of said legs extend downwardly at about 90° to said initial portions, one of said downwardly depending leg portions constituting a long leg portion and the other of said downwardly depending leg portions constituting a short leg portion, the long leg portion of the latch means for each panel extending downwardly into the upper end of the opening of the same one of said first and second frame members and is captively mounted in said opening, said latch means being rotatable in said opening about the axis of said long leg portion and vertically shiftable axially of said long leg portion, when the first and second frame members of adjacent panels are joined together, said latch means being shiftable and rotatable from a normal unactuated position wherein said latch means handle portion rests on the upper end of said frame member in which it is captively mounted with its short leg portion lying along one side of that frame member, to an intermediate raised position wherein said latch means short leg portion clears the upper ends of said frame members and is aligned with the opening of that frame member it is to engage, and to an actuated position wherein said short leg enters and engages said opening of said last mentioned frame member and said latch handle portion rests on the upper ends of said frame members, completing the joinder of said adjacent panels.

12. The attachment system claimed in claim 11 including a pair of upsets formed on said long leg portion of each latch means near the free end of said long leg portion, a coil spring mounted on said long leg portion above said upsets, a ring mounted on said long leg portion above said spring and slidable along said long leg portion, said upsets and said ring comprising seats for the ends of said spring, a roll pin extending from side to side of the frame member opening in which said long leg portion is located, said roll pin engaging said ring to slightly compress said coil spring and to render said latch means long leg portion captive in its respective frame member bore, said coil spring urging said latch means to either of its normal unactuated positions and to its actuated position.

13. The attachment system claimed in claim 12 wherein said latch member short leg portion lies at a slight angle to said long leg portion and is so spaced therefrom as to engage its respective frame member opening with a wedging action.

14. The attachment system claimed in claim 13 including a compressible O-ring on said shouldered portion of said headed stud to urge said corresponding abutment surfaces at said lower ends of said frame members into abutting relationship.

15. The attachment system claimed in claim 14 wherein said corresponding abutment surfaces of each of said first and second frame members comprise parallel edges formed by the junctures of said face of said frame member with the sides thereof, said frame member face between said abutment surfaces being slightly inset thereof.

16. The attachment system claimed in claim 15 including a strip of opaque resilient material mounted on the faces of at least one of said first frame members and said second frame members to render the abutment joint between first and second frame members of attached adjacent panels light tight.

17. The attachment system claimed in claim 13 wherein each of said first fra,e members captively supports said latch means and has said notch and bore formed in its face, and each of said second frame members has said headed stud and said alignment stud extending from its face.

18. The attachment system claimed in claim 13 wherein said first and second frame members of each panel comprise integral one-piece parts of the panel body.

* * * * *